US005145419A

United States Patent [19]

Yamanashi et al.

[11] Patent Number: 5,145,419

[45] Date of Patent: Sep. 8, 1992

[54] CONNECTOR WITH A TERMINAL LOCK

[75] Inventors: Makoto Yamanashi; Isao Kameyama, both of Shizuoka, Japan

[73] Assignee: Yazaki Corporation, Tokyo, Japan

[21] Appl. No.: 653,326

[22] Filed: Feb. 11, 1991

[30] Foreign Application Priority Data

Feb. 19, 1990 [JP] Japan ..... 2-14759[U]

[51] Int. Cl.[5] ..... H01R 13/436

[52] U.S. Cl. ..... 439/752; 439/595

[58] Field of Search ..... 439/594, 595, 752

[56] References Cited

U.S. PATENT DOCUMENTS

| | | | |
|---|---|---|---|
| 4,660,915 | 4/1987 | Mantlik | 339/61 |
| 4,785,182 | 7/1988 | Anbo et al. | 439/592 |
| 4,946,398 | 8/1990 | Takenouchi et al. | 439/599 |
| 4,973,268 | 11/1990 | Smith et al. | 439/595 |

FOREIGN PATENT DOCUMENTS 1-164685 11/1989 Japan .

*Primary Examiner*—Eugene F. Desmond

*Attorney, Agent, or Firm*—Nikaido, Marmelstein, Murray & Oram

[57] ABSTRACT

The connector with a terminal lock consists of: a connector housing having a plurality of terminal accommodating chambers; and a terminal lock mounted to the rear portion of the connector housing. The terminal lock has insertion openings formed therethrough at locations corresponding to the terminal accommodating chambers. The terminal lock also has a plurality of pairs of a flexible terminal guiding piece and a flexible terminal holding piece, the paired pieces projecting forwardly from the opposing surfaces of each insertion opening. Coupling means are provided to the mating portions of the connector housing and the terminal lock so that the terminal lock is mounted to the connector housing first in a half-coupled state and then in a full-coupled state. With the terminal lock half-coupled, the terminal lugs can be smoothly guided by the terminal guiding pieces into the terminal accommodating chambers in the connector housing.

5 Claims, 3 Drawing Sheets

CONNECTOR WITH A TERMINAL LOCK

BACKGROUND OF THE INVENTION

1. Field of the Invention

The present invention relates to a connector used for connecting wiring harnesses and more particularly to a connector structure having a terminal lock mounted to a connector housing to prevent a terminal lug inserted into the terminal accommodating chamber of the connector housing from slipping off backwardly.

2. Prior Art

A general practice of locking the terminal lug inserted into the terminal accommodating chamber in the connector housing is by forming a flexible engagement piece integral with the inner wall of the terminal accommodating chamber and then engaging the terminal lug inserted into the chamber with the flexible engagement piece to prevent the terminal lug from slipping off backwardly from the terminal accommodating chamber. In recent years, there has been proposed a structure in which a terminal lock is mounted to the rear part of the connector housing so that the terminal lock, either in combination with or in place of the flexible engagement piece, can reliably prevent the slip-off of the terminal lug.

In this structure, the terminal lock is coupled to the connector housing through a two-step coupling process, which involves a partial or half-coupled state that allows the terminal lug to be inserted into the terminal accommodating chamber and a full-coupled state that locks the terminal lug.

In FIG. 4, denoted *a* is a connector housing and *b* a terminal lock. The terminal lock *b* is shown half-coupled to the connector housing *a* (engagement mechanism of these two members are not shown).

Provided inside the connector housing *a* are a plurality of terminal accommodating chambers *c*, each of which is provided with a flexible engagement piece *e* that engages a terminal lug *d* as shown in FIG. 5. The terminal lock *b* is formed with insertion openings *f* corresponding to the terminal accommodating chambers *c* through which the terminal lugs *d* are inserted. The terminal lock *b* is also formed with terminal holding pieces *g* that are inserted into respective terminal accommodating chambers *c*.

In the above construction, as the terminal lugs *d* are inserted through the insertion openings *f* into the terminal accommodating chambers *c*, the advancing terminal lugs *d* deflect the terminal holding pieces *g* located in the insertion path, and further advances deflecting the flexible engagement pieces *e*. When the terminal lugs *d* are fully inserted, the terminal holding pieces *g* and the flexible engagement pieces *e* snap back to their original shapes.

However, this structure has drawbacks. That is, there is a gap between the terminal lock *b* and the connector housing *a* and since the terminal lug *d* easily inclines, pushed by the reactionary force of the terminal holding piece *g*, as it passes through the terminal lock *b*, the front end $d_1$ of the terminal lug *d* being inserted abuts against the rear end $a_1$ of the connector housing *a*. As a result, the terminal insertion work cannot be performed smoothly.

SUMMARY OF THE INVENTION

The present invention has been accomplished to overcome the above drawbacks and its objective is to provide a connector that enables smooth insertion of the terminal lugs into the connector housing even when the terminal lock is half-coupled to the connector housing.

To achieve the above objective, a connector of this invention comprises: a connector housing having a plurality of terminal accommodating chambers; and a terminal lock coupled to the rear portion of the connector housing through a two-step coupling process involving a half-coupled state and then a full-coupled state, said terminal lock having a plurality of pairs of a terminal holding means and a terminal guiding means facing each other, each of said pairs being inserted into the corresponding terminal accommodating chamber in the connector housing when the terminal lock is coupled to the connector housing; whereby when the terminal lock is half-coupled to the connector housing, the terminal lugs being inserted are guided by the terminal guiding means into the terminal accommodating chambers in the connector housing.

PREFERRED EMBODIMENT OF THE INVENTION

Figure 1:
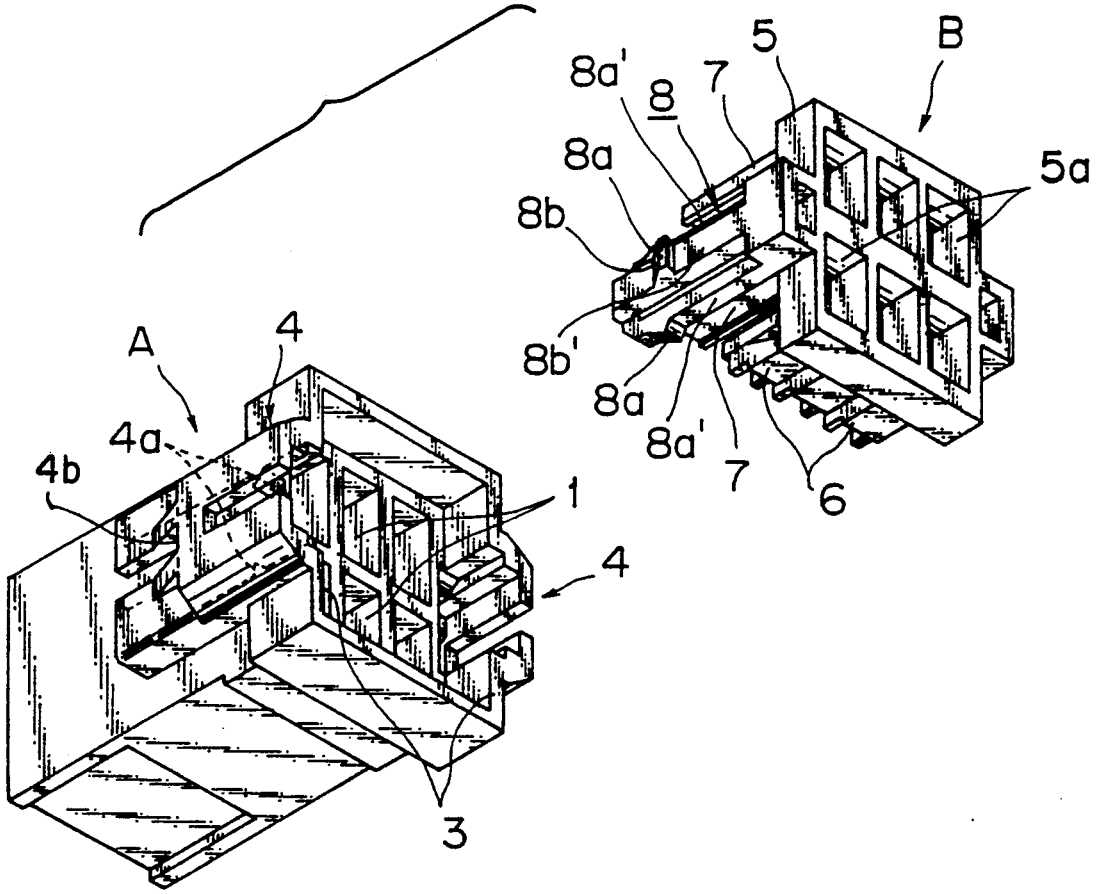
FIG. 1 is an exploded perspective view of one embodiment of this invention.

Designated A and B are a connector housing and a terminal lock, respectively, each of which is formed as one piece of synthetic resin material.

The connector housing A has a plurality of terminal accommodating chambers 1, in each of which a flexible engagement piece 2 is provided. On side walls 3 of the connector housing A are formed coupling frames 4, each consisting of a half-coupling portion 4*a* and a full-coupling portion 4*b*.

The terminal lock B has a plurality of insertion openings 5*a* formed in a frame 5 at positions corresponding to the terminal accommodating chambers 1. The frame 5 has a terminal holding piece 6 projecting forwardly from the upper side of each insertion opening 5*a* and a terminal guiding piece 7 projecting forwardly from the lower side of each insertion opening 5*a*.

The frame 5 has coupling portions 8 on each lateral side thereof that face the coupling frames 4. The coupling portion 8 consists of: a pair of flexible coupling pieces 8*a*' each having a half-coupling projection 8*a* that engages with the half-coupling portion 4*a*; and a flexible coupling piece 8*b*' having a full-coupling projection 8*b* that engages with the full-coupling portion 4*b*.

Figure 2:
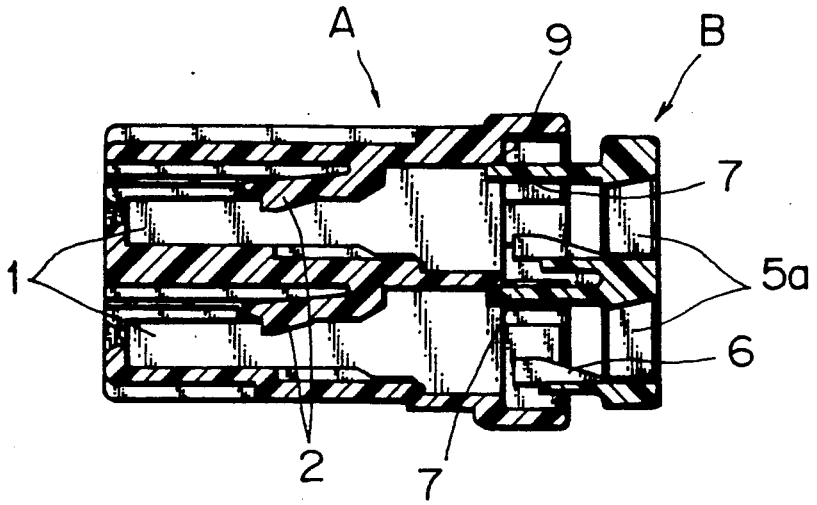
FIG. 2 is a cross section of the embodiment in a half-coupled state.

FIG. 2 shows the terminal lock B mounted to the connector housing A in a half-coupled condition, with the terminal guiding pieces 7 extending beyond an abutment surface 9 at the rear part of the connector housing A and reaching the terminal accommodating chambers 1.

Figure 3:
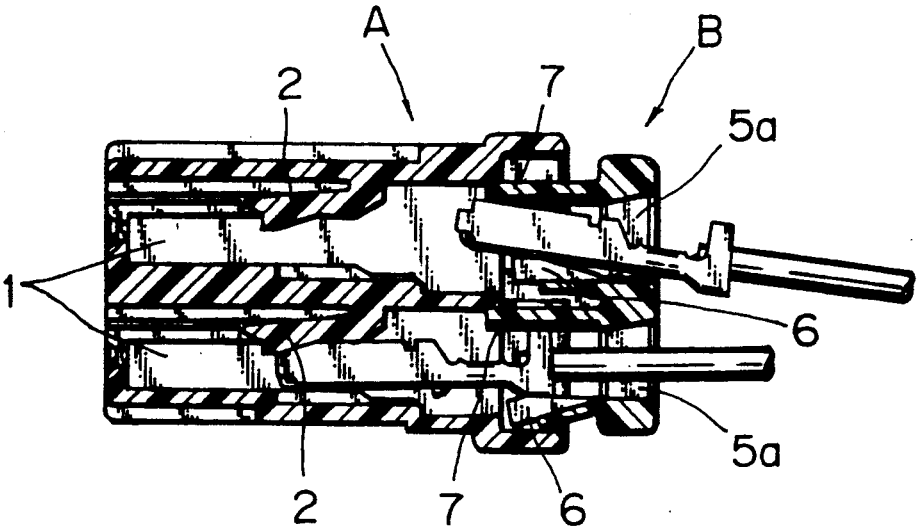
FIG. 3 is a cross section of the embodiment with the terminal lugs being inserted.
Figure 4:
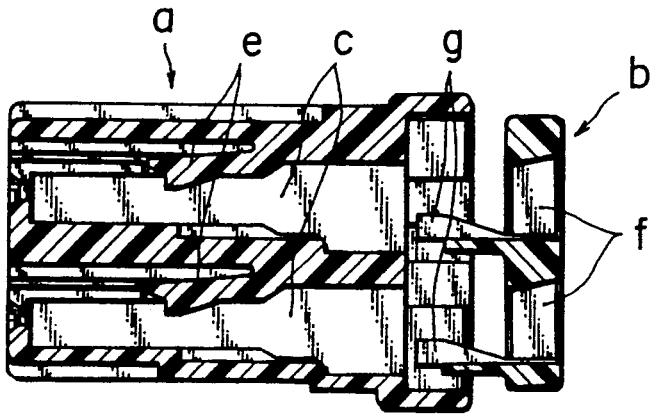
FIG. 4 (PRIOR ART)
FIG. 4 is a cross section of a conventional connector in a half-coupled state.
Figure 5:
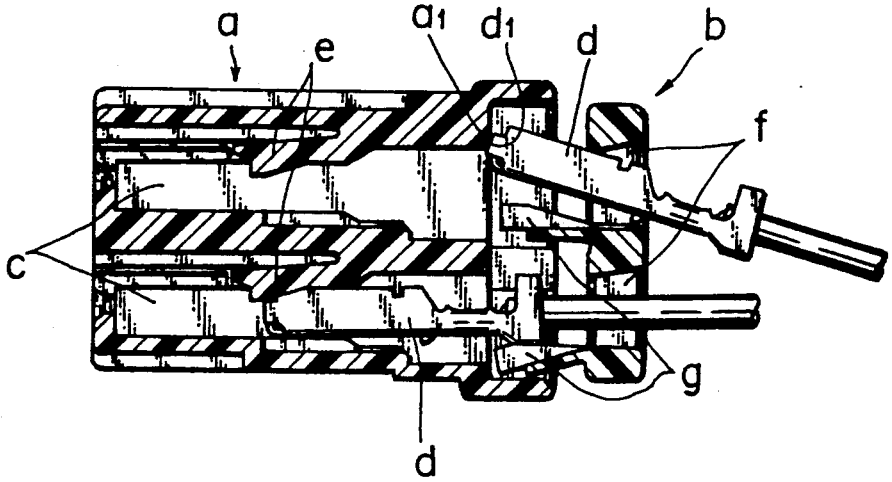
FIG. 5 (PRIOR ART)
FIG. 5 is a cross section of the conventional connector with terminal lugs being inserted.

When, in this condition, the terminal lug C is inserted as shown in FIG. 3, it is smoothly guided by the terminal guiding piece 7 into the terminal accommodating chamber 1. When the process of inserting the terminal lug C is completed, the terminal lock B is pushed into the full-coupled state.

The construction and advantage of this invention may be summarized as follows. As mentioned above, the connector of this invention consists of: a connector housing having terminal accommodating chambers; and a terminal lock which is to be mounted to the connector housing and has terminal holding pieces to be inserted into respective terminal accommodating chambers. The terminal lock is mounted to the rear portion of the connector housing first in a half-coupled state and then in a full-coupled state. The terminal lock has terminal guiding pieces each projecting in the same direction as and facing the corresponding terminal holding piece. With the terminal lock half-coupled to the connector housing, the terminal lugs, as they are inserted, are guided by the terminal guiding pieces into the terminal accommodating chamber. Unlike the conventional connectors in which the terminal lugs being inserted are prone to abut against the rear end of the connector housing, the connector of this invention ensures smooth insertion of the terminal lugs into the terminal accommodating chamber by the terminal guiding pieces.

What is claimed is:

1. A connector with a terminal lock comprising:

a connector housing having terminal chamber means including at least one terminal chamber having therein a first terminal holding means, an abutment surface being formed at a rear opening of said chamber;

a terminal lock coupled to a rear portion of the connector housing by coupling means engaged through a two-step coupling process involving a first partial coupling state and a second full coupling state, said terminal lock having at least a pair of second terminal holding means and terminal guiding means facing each other at an insertion opening means positioned corresponding to said at least one terminal chamber, said terminal guiding means being partially inserted into said at least one terminal chamber in the connector housing when the terminal lock is partially coupled to the connector housing in said first coupling state;

such that when the terminal lock is partially coupled to the connector housing in the first coupling state, a terminal lug, as it is inserted into said insertion opening means, is guided by the terminal guiding means past said abutment surface into the at least one terminal chamber in the connector housing to engage said first terminal holding means;

and subsequent movement of said terminal lock to the second full coupled state engages said second terminal holding means to lock said terminal lug in said at least one terminal chamber.

2. A connector with a terminal lock as claimed in claim 1, wherein said terminal chamber means includes a plurality of terminal chambers and wherein said terminal lock insertion opening means has as many insertion openings formed therein as the number of terminal chambers in the terminal chamber means in the connector housing, in such a way that the insertion openings are located at positions corresponding to each of the terminal chambers.

3. A connector with a terminal lock as claimed in claim 1, wherein said paired terminal holding means and terminal guiding means are formed flexible and integral with the terminal lock and project forwardly from opposing surfaces of each insertion opening in the terminal lock.

4. A connector with a terminal lock as claimed in claim 1, wherein said connector housing has coupling frames formed at the lateral sides thereof and the terminal lock has coupling portions at the lateral sides thereof so that the coupling frames and the mating coupling portions engage each other to provide the first partial coupling state and the second full coupling state.

5. An electrical connector comprising:

a connector housing having at least a chamber longitudinally extending in the connector housing for frictionally engagedly accommodating therein a terminal lug and having at an end thereof an opening communicating with the chamber for the insertion of the terminal lug therethrough into the chamber, said opening having a cross-sectional dimension larger than that of the chamber and creating an abutment surface in the chamber;

a terminal lock having a plug means insertedly fittable into the opening communicating with the chamber and being coupled to the connector housing by coupling means engaged to the connector housing and the terminal lock through a two-step coupling process involving a first partial coupling state and a second full coupling state, said terminal lock further having at least a pair of terminal holding means and terminal guiding means which extend from the plug means integrally therewith towards a direction of insertion of the terminal lock into the connector housing and face each other transversely to said direction, and each of said at least a pair of terminal holding means and terminal guiding means being partially inserted into the connector housing when the terminal lock is partially coupled to the connector housing in said first coupling state;

such that when the terminal lock is partially coupled to the connector housing in the first coupling state, a terminal lug, as it is inserted into the chamber through the terminal lock and the opening of the connector housing, passes over and deflects the terminal holding means and is guided by the terminal guiding means so as not to be entrapped against said abutment surface but to enter into the chamber, so as to allow the terminal lug which has passed over the terminal holding means and entered into the chamber, to lockedly engage said terminal holding means;

and subsequent movement of said terminal lock to the second full coupling state fits the plug means insertedly into the end opening to close the opening and accommodates the terminal lug frictionally engagedly in the chamber at said full coupling state.

* * * * *